United States Patent [19]

Collie

[11] Patent Number: 4,995,186

[45] Date of Patent: Feb. 26, 1991

[54] INFLATABLE WARNING SIGN

[75] Inventor: Russell Collie, Lake Worth, Fla.

[73] Assignee: Boudreau and Collie, Lake Worth, Fla.

[21] Appl. No.: 511,744

[22] Filed: Apr. 20, 1990

[51] Int. Cl.[5] ..... G09F 21/04

[52] U.S. Cl. ..... 40/591; 40/600; 40/610; 40/540; 446/486; 362/812

[58] Field of Search ..... 40/610, 612, 212, 540, 40/555, 591, 600; 446/485, 226; 362/812, 80.1, 83.3, 61, 154, 363, 806

[56] References Cited

U.S. PATENT DOCUMENTS

| | | | |
|---|---|---|---|
| 1,776,182 | 9/1930 | Cook . | |
| 2,383,390 | 8/1945 | Jacobs | 40/127 |
| 2,561,016 | 7/1951 | Ford | 40/125 |
| 2,592,444 | 4/1952 | Matelena | 362/812 |
| 2,748,256 | 5/1956 | Moran | 446/485 |
| 2,762,327 | 9/1956 | Weig | 116/63 |
| 2,808,803 | 10/1957 | Weig | 116/63 |
| 2,816,378 | 12/1957 | Levinson | 40/130 |
| 2,922,152 | 1/1960 | Del Conte | 340/366 |
| 2,960,786 | 11/1960 | Wagner | 40/600 |
| 3,197,628 | 7/1965 | Schuff | 240/6.4 |
| 3,233,352 | 2/1966 | Projector | 40/130 |
| 3,250,241 | 5/1966 | Levy | 116/63 |
| 3,305,961 | 2/1967 | Lanzon | 40/129 |
| 3,345,978 | 10/1967 | Letsinger | 40/212 |
| 3,440,748 | 4/1969 | Hackley | 40/129 |
| 3,536,906 | 10/1970 | Bloom | 446/485 |
| 3,672,083 | 6/1972 | Moran | 40/540 |
| 3,745,677 | 7/1973 | Moran | 40/126 |
| 3,786,412 | 1/1974 | Capriotti | 340/54 |
| 3,810,092 | 5/1974 | Tucker | 340/107 |
| 3,936,967 | 2/1976 | Davis | 40/129 |
| 4,052,806 | 10/1977 | George | 40/129 |
| 4,279,088 | 7/1981 | Hyre | 40/442 |
| 4,542,445 | 9/1985 | Marletta | 446/485 |
| 4,586,456 | 5/1986 | Forward | 446/485 |

FOREIGN PATENT DOCUMENTS

| | | | |
|---|---|---|---|
| 2460517 | 5/1979 | France | 446/485 |
| 8605255 | 9/1986 | PCT Int'l Appl. | 446/485 |

*Primary Examiner*—Laurie K. Cranmer
*Assistant Examiner*—Cassandra L. Hope
*Attorney, Agent, or Firm*—James M. Deimen

[57] ABSTRACT

An improved inflatable warning sign having a flashing light contained within the sign and a magnetic base to retain the sign to the roof or truck lid of a disabled vehicle. The sign as inflated is a prismatic triangele to maximize the visible rectangular area for lettering and minimize the wind resistance.

In the preferred embodiment the light within the sign is red and the inflated bag is white with black lettering. The white bag disperses the red light within evenly, thus permitting much more effective use of a single incandescent bulb within a translucent red covered box. Deflated, a sign with an inflated lettering area of 8 by 17 inches folds into a package or pouch that easily fits within the glove box of an automobile.

9 Claims, 1 Drawing Sheet

INFLATABLE WARNING SIGN

BACKGROUND OF THE INVENTION

The field of the invention pertains to warning devices and signs that may be conveniently carried in an automobile and attached to the outside thereof in the event of emergency or disablement of the vehicle. In particular, the invention pertains to signs that may be conveniently attached to the exterior of a disabled vehicle to warn away other vehicles and to obtain help.

Signs and signal devices for automobiles in distress or for informational purposes are disclosed in the prior art. In particular, U.S. Pat. No. 3,810,092 illustrates a collapsible free standing multiple flag sign and U.S. Pat. No. 2,922,152 and U.S. Pat. No. 3,305,961 each disclose smaller illuminated signs fastenable to a vehicle exterior. U.S. Pat. No. 3,440,748 discloses a magnetically attachable non-collapsible sign for a vehicle roof.

Also, disclosed in the prior art are inflatable illuminated advertizing and display devices as shown in U.S. Pat. No. 1,776,182 and U.S. Pat. No. 2,816,378 illuminated from the interior and exterior respectively. Inflatable illuminated airport signs are illustrated in U.S. Pat. No. 3,233,352 and highway barricades in U.S. Pat. No. 3,197,628. Other inflatable highway traffic diverters are disclosed in U.S. Pat. No. 2,762,327 and U.S. Pat. No. 2,808,803.

U.S. Pat. No. 2,383,390 and U.S. Pat. No. 3,250,241 disclose tethered inflatable display and signalling balloons, the latter being fastenable to the roof of an automobile. U.S. Pat. No. 4,052,806 discloses a rigid illuminated triangular automobile roof top sign for permanent installation and U.S. Pat. No. 3,936,967 discloses a triangular collapsible temporary sign attachable to an automobile. An inflatable illuminated figure is disclosed in U.S. Pat. No. 3,745,677, the figure having a separate pocket for the light.

Although many of the above devices are well suited for their intended uses, they are generally cumbersome and inconvenient when carried within an automobile. None appear to be suited for carrying, even in the collapsed state, in a small glove compartment and yet of sufficient size and stability to be useful when assemble or inflated. Sufficient size is required to provide space for lettering. Stability is required to retain the sign in place despite sudden wind gusts from passing trucks.

SUMMARY OF THE INVENTION

The invention comprises an improved inflatable warning sign having flashing lighting means contained within the sign and a magnetic base to retain the sign to the roof or trunk lid of a disabled vehicle. The sign as inflated is a prismatic triangle to maximize the visible rectangular area for lettering and to minimize the wind resistance. The magnetic base and the illuminating means are assembled in a box with a translucent or transparent top, the entire box being inset in the base of the sign as inflated. The inset base permits the inflated sign to rest snugly against the vehicle roof or trunk lid, an important feature to lessen wind resistance and in turn the tendency of the sign to be blown off the vehicle by a passing truck.

When the sign is deflated and folded, the entire unit is not much larger than the illumination box. In the preferred embodiment, the sign fits easily within a small pouch in turn easily fitted into a vehicle glove compartment.

In the preferred embodiment, the lighting box has a translucent red cover and the inflated sign portion or bag is white with black lettering. The white bag disperses the red light from the box evenly within the bag thus permitting very effective use of a single small incandescent bulb in the box. As an example, a sign with an inflated lettering area of 8 by 17 inches folds deflated into a pouch 6 by 8 inches that easily fits within the glove box of an automobile.

DESCRIPTION OF THE PREFERRED EMBODIMENT

Figure 1:
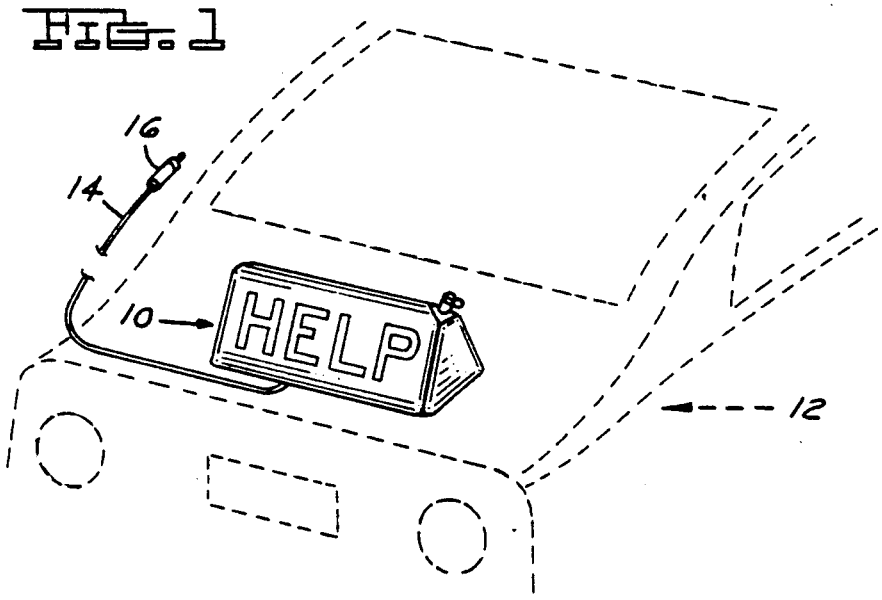
FIG. 1 is a perspective view of the warning sign inflated and placed on a vehicle.

In FIG. 1 the warning sign generally denoted by 10 is shown placed on the deck lid or trunk lid of a vehicle generally denoted by 12. The sign includes an electric cord 14 attached thereto and a plug 16 attached to the extended other end of the cord 14. The plug is adapted to fit in a cigar lighter socket commonly found in the dashboard of a vehicle and provides electric energy from the vehicle to the sign.

Figure 2:
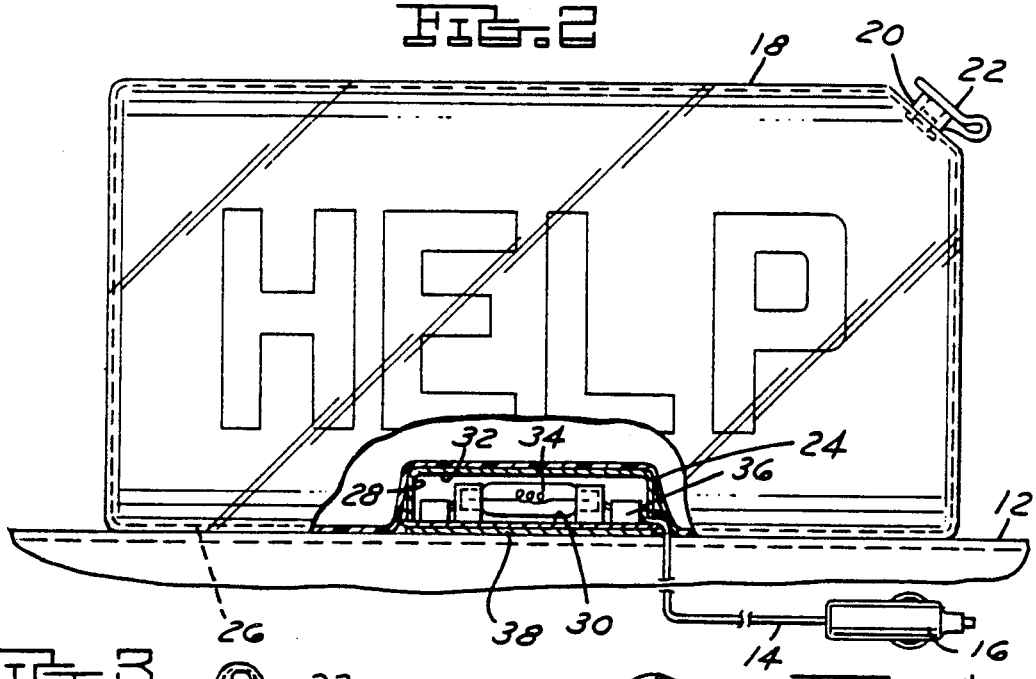
FIG. 2 is a side view partially cut away of the inflated warning sign.
Figure 3:
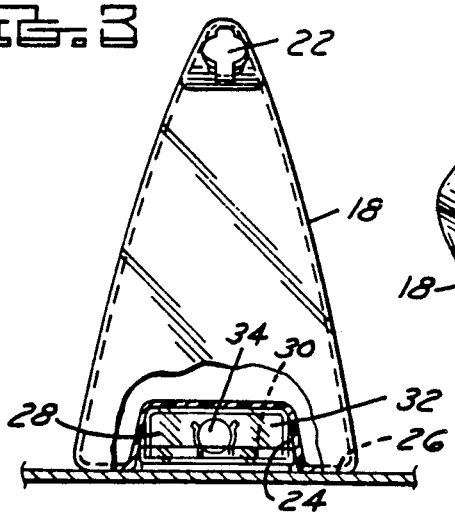
FIG. 3 is an end view partially cut away of the warning sign as inflated; and, FIG. 4 is a perspective view of the warning sign deflated and folded for insertion into a pouch.

As shown in FIGS. 2 and 3, the sign is constructed from a sealed plastic bag 18 of generally triangular prismatic shape when inflated. The bag includes an inflation port 20 having a plug 22 there attached similar to the inflation ports for air mattresses. The bag 18 may be formed from plastic material such as polyethylene or polypropylene coated on the inside or impregnated with a white pigment for white translucence. Other plastic materials with similar translucent properties may be substituted for the plastic suggested above.

The bag 18 is formed with a pocket 24 in the base 26 of the bag 18. Within the pocket 24 is a hard plastic box 28 having a bottom 30 and a red translucent cover 32. The box 28 may be formed of red translucent acrylic or other suitable plastic that will not be softened by the head of a small 12 volt incandescent light bulb 34 therewithin. As an optional item a flasher unit 36 such as that used for emergency or turn signals may be included in the box 28 with the bulb 34. A suitable size for the box is approximately three inches by five inches by one inch.

The box 28 is adhesively affixed to the pocket 24 of the bag 18 by a suitable transparent glue between the cover 32 and the pocket 24. The bottom 30 of the box 28 may be easily snapped on and off the cover 32 to replace the bulb 34 or flasher 36.

On the bottom 30 of the box 28 is a magnetic plate 38 permanently fastened thereto. The magnetic plate 38 holds the sign to the vehicle 12. As an option small magnetic pieces may be affixed to the four corners of the base 26 of the bag 18 or about the periphery of the base of the bag. The pocket 24 for the box 28, permits the base 26 to be retained close to the vehicle surface, thereby substantially reducing the effect of puffs of wind on the sign. The triangular prismatic shape also helps to reduce the effect of the wind on the sign. Because the sign is very light in weight for its inflated size, the effect of the wind on the sign is of substantial importance. Typically, the sign is used to identify the need for assistance on a vehicle that is parked on the shoulder of a road. Passing trucks create puffs of wind that are sufficient to rock the vehicle and therefore would easily blow away a lightweight sign not properly shaped and held down tightly to the vehicle.

Figure 4:
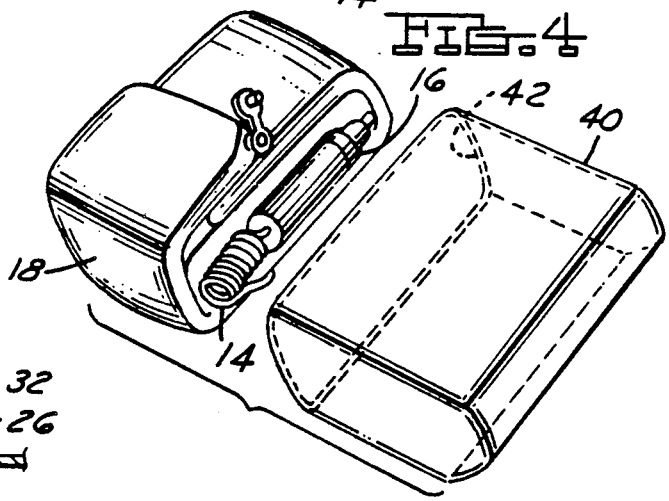

When not is use the sign is kept deflated and the bag 18 folded about the box 28 as shown in FIG. 4. The folded sign fits within a pouch 40 constructed of the same or a similar plastic as the bag. The pouch 40 opening 42 includes means about the opening to seal the pouch closed as an optional feature. A suitable reusable seal is that used for sandwich bags and produce where the seal can be reclosed by running a thumbnail therealong.

I claim:

1. An illuminated sign comprising a substantially airtight translucent bag, inflation means on the bag, said bag inflatable to a generally triangular prismatic shape with one of the rectangular sides thereof being the base of the bag, illumination means for said sign comprising a box, lighting means in the box and a translucent cover forming a part of the box, a pocket molded into the base of the bag and sized to accept the box, said pocket being separate from the box, means externally attaching the box in the pocket of the bag with the translucent cover facing the inside of the bag, the bottom of the box being substantially flush with the base of said bag as inflated, and means on the bottom of the sign for attachment to a vehicle.

2. The illuminated sign of claim 1 wherein said bag is formed of white translucent plastic and the cover of the box is formed of red translucent plastic.

3. The illuminated sign of claim 1 wherein the lighting means includes intermittent flashing means.

4. The illuminated sign of claim 1 wherein the bag as deflated folds to a size about the box not more than twice the size of the box.

5. The illuminated sign of claim 1 wherein the box contains a single incandescent light bulb.

6. An inflatable illuminated sign comprising a substantially airtight white translucent bag, inflation means for the bag, said bag inflatable to a generally triangular prismatic shape with one of the rectangular sides thereof being the base of the bag, an illumination box attached to the base of the bag, said box having a red translucent portion thereof facing the inside of the bag, a single incandescent light in the box and flasher means electrically connected to the light, and, a pocket molded into the base of the bag, said pocket being separate from the box and said box being located and externally attached to the bag in said pocket, with the bottom of the box substantially flush with the base of the bag, and, means on the bottom of the sign for attachment to a vehicle.

7. The inflatable illuminated sign of claim 6 wherein the attachment means on the bottom of the sign include magnetic attachment means on the bottom of the box.

8. The inflatable illuminated sign of claim 6 wherein the attachment means on the bottom of the sign include magnetic attachment means located adjacent the periphery of the base of the bag.

9. The inflatable illuminated sign of claim 6 wherein the bag is deflatable and foldable to a size about the box not substantially more than twice the size of the box.

* * * * *